United States Patent [19]

Elliott

[11] Patent Number: 4,700,678

[45] Date of Patent: Oct. 20, 1987

[54] FUEL INJECTOR

[76] Inventor: George D. Elliott, 14902 Clovercrest Dr., Huntsville, Ala. 35803

[21] Appl. No.: 904,378

[22] Filed: Sep. 8, 1986

[51] Int. Cl.[4] ..... F02M 49/02

[52] U.S. Cl. ..... 123/297; 239/87

[58] Field of Search ..... 123/506, 297; 239/87

[56] References Cited

U.S. PATENT DOCUMENTS

| | | | |
|---|---|---|---|
| 4,247,044 | 1/1981 | Smith | 239/87 |
| 4,394,856 | 7/1983 | Smith et al. | 123/506 |
| 4,427,151 | 1/1984 | Trenne | 239/87 |

*Primary Examiner*—Tony M. Argenbright

*Attorney, Agent, or Firm*—George J. Porter

[57] ABSTRACT

An injector (10) for delivering fuel directly into an engine combustion chamber (11) in response to compression within the combustion chamber (11). The injector (10) has a housing (14) with an injector rod (22) slidably mounted within housing (14). Secured to the injector rod (22) is a primary piston (24), a metering spool (25), and a secondary piston (32). The metering spool (25) is located within a metering chamber (26) having a bypass chamber (50) in which is located two series of electrodes (60 and 62) which are connected to an electrical system which sequentially provides an electrical signal to the connector (56) as dictated by the needs of the engine. As the electrical signal is supplied to connector (56), an electro-rheological fluid (64) contained within the metering chamber (26) is converted from a liquid to a substantially solid condition, thereby limiting the travel of the metering spool (25) and the secondary piston (32). Thus, a predetermined, measured amount of fuel is delivered from the supply chamber (36) into the combustion chamber (11) of the engine. The device (10) is provided with a glow plug (68) for firing the mixture within the combustion chamber (11).

7 Claims, 5 Drawing Figures

FUEL INJECTOR

TECHNICAL FIELD

This invention relates in general to an injector for delivering fuel directly into an engine combustion chamber, and in particular to a compression operated injector which utilizes an electro-rheological fluid to control the amount of fuel to be delivered into the engine combustion chamber.

BACKGROUND OF THE INVENTION

Fuel injectors are required to deliver closely calibrated amounts of fuel in rapid succession under extreme conditions of pressure and temperature. Because of the great demands placed upon them, fuel injectors are typically quite complex and therefore expensive to manufacture. This invention utilizes the properties of an electro-rheological fluid in a unique way to minimize both the complexity and cost of fuel injectors while at the same time providing improved operational characteristics.

Electro-rheological fluids comprise slurries of finely divided hydrophilic solids in hydrophobic liquids. In the absence of an electric field these fluids behave in Newtonian fashion, but when an electric field is applied, the fluid becomes more viscous as the potential of the electric field is increased. This viscosity change continues until the fluid becomes substantially a solid upon application of a sufficient potential. The viscosity transformation of this fluid occurs in a very short period of time. An electro-rheological fluid thus provides an excellent medium for carrying out the present invention.

Electro-rheological fluids have been extensively used in clutches as disclosed, for example, by JAMES E. STANGROOM in U.S. Pat. Nos. 4,444,298 and 4,493,615.

Various forms of compression operated injectors have been proposed. In the more recent of these prior art devices, the injection of fuel can be controlled electronically. .Typically these devices utilize solenoid valves to control the timing and the amount of fuel to be supplied.

Examples of compression operated injectors are included in U. S. Pat. Nos. Re. 23,476 to L. O. FRENCH; Re. 29,978 and 3,926,169 to LESHNER et al.; 1,995,a469 to S. D. OLSEN; 3,055,593, 3,060,912, 3,060,913, and 3,081,758 to C. H. MAY; 4,066,046 to R. E. MCALISTER; 4,095,580 to MURRAY et al.; 4,197,996 to D. S. GIARDINI; 4,247,044, 4,306,680, and 4,394,856 to SMITH et al.; and 4,427,151 to M. U. TRENNE.

The patents to GIARDINI, SMITH, and TRENNE utilize solenoid valves for fuel control.

Review of these prior art injectors shows them to be quite complex and expensive to manufacture. Additionally, because of the speed at which injectors must function, inertia of the moving parts, particularly solenoid valves, has a detrimental effect upon efficient performance.

It will be seen that these and other shortcomings of the prior art are effectively overcome by the present invention.

Because of its simplicity and unique operation when compared to conventional injectors the invention is particularly well suited for converting conventional carburetor engines to fuel injection, thus greatly improving performance. The invention permits the unrestricted flow of air through the intake manifold of a conventional internal combustion engine, thus providing a complete charge of air into each cylinder on each intake stroke. As the air is compressed during the compression stroke without the presence of fuel therein, there can be no detonation or preignition. Thus a great variety of either high or low octane fuels may be utilized by simply changing the timing of the injection of the fuel into the cylinders. Further, the device permits total control of the engine timing and output by precisely timed application of an electrical impulse.

DETAILED DESCRIPTION OF THE INVENTION

Figure 1:
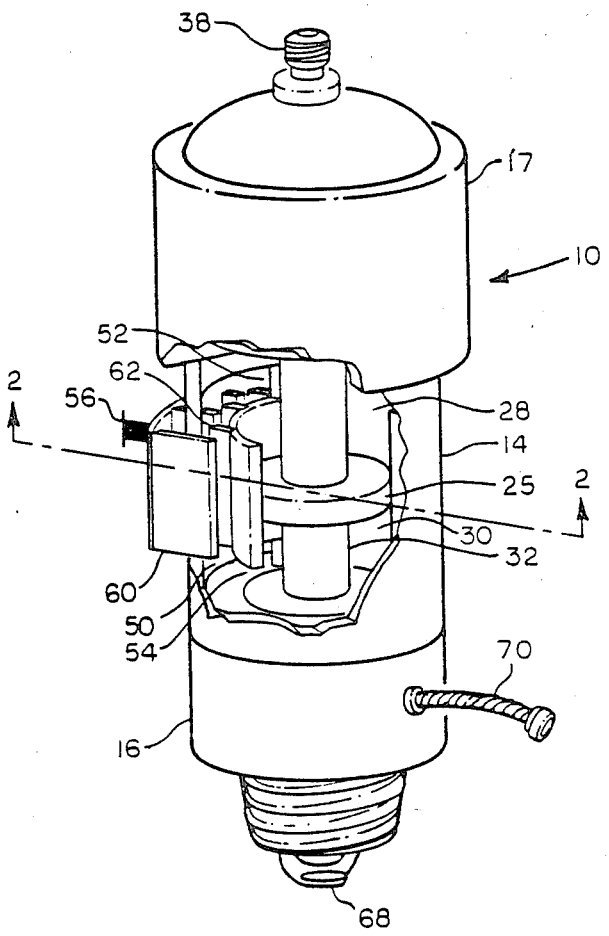
FIG. 1 is an elevational perspective view of the device with portions cut away to show inner details of the invention.
Figure 3:
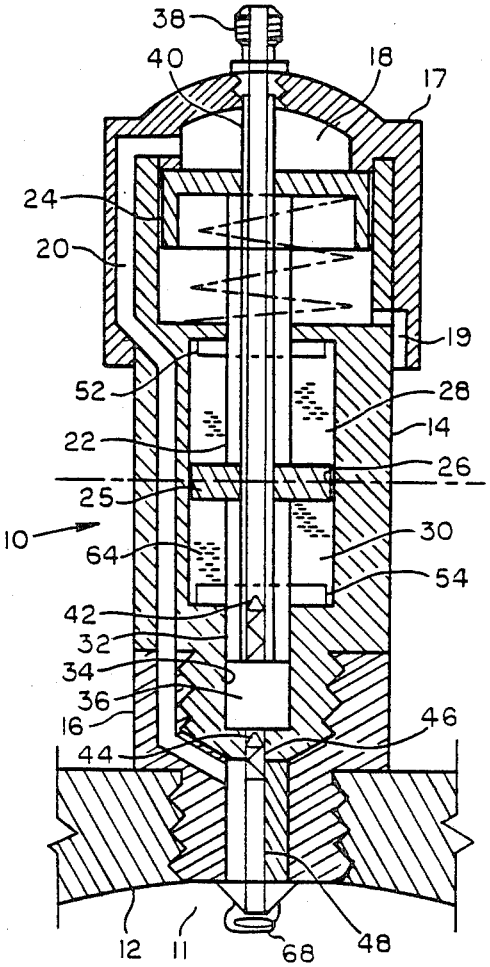
FIG. 3 is a sectional elevational view taken along lines 3—3 of FIG. 2.

FIG. 1 is a perspective view (partially cut away) illustrating the fuel injector 10 of the present invention. As more clearly seen in FIG. 3 injector 10 is adapted for threaded engagement into a cylinder head 12 of an internal combustion engine. The injector comprises a housing assembly which is made up of three basic housings, the details of which will be described hereinafter.

An injector housing 14 is threadedly attached to a nozzle housing 16 at its lower end. The nozzle housing in turn is threadedly attached to the cylinder head 12. At the upper end of injector housing 14 is attached a compression chamber housing 17 which in combination with the injector housing 14 forms a compression chamber 18. Compression chamber 18 communicates with a combustion chamber 11 of cylinder head 12 through a compression passage 20 which is formed by the compression chamber housing 17, the injector housing 14, and the nozzle housing 16. An injector rod 22 is slidably mounted within injector housing 14. At the upper end of injector rod 22 is attached a primary piston 24 which is located within the compression chamber 18. The area below primary piston 24 is vented to the atmosphere by a passage 19. A metering spool 25 is rigidly attached to the mid portion of the injector rod 22 and is slidably mounted in a metering chamber 26 which is formed in the intermediate portion of the injector housing 14. The metering spool 25 effectively separates the metering chamber 26 into an upper chamber 28 and a lower chamber 30. At the lower end of injector rod 22 is formed a secondary piston 32 which slidably engages a cylinder wall 34 which forms a fuel supply chamber 36 within the lower portion of the injector housing 14. At the upper portion of the injector a fuel inlet fitting 38 is threadedly attached to the combustion chamber housing 17 and is also rigidly attached to a fuel supply tube 40 which passes through and slidably engages the center portion of injector rod 22. A spring biased check valve 42 is mounted within the lower portion of the fuel supply tube 40 to prevent reverse flow of fluid in the supply tube. An additional check valve 44 is provided in a lower passage 46 which communicates with a passage 48 formed in the nozzle housing. Passage 48 thus communicates with compression passage 20 as well as with the fuel supply passage 46. The valve 44 serves to prevent combustion pressures from entering fuel supply chamber 36 but allows pressurized fuel to pass en route to the combustion chamber 11.

Figure 5:
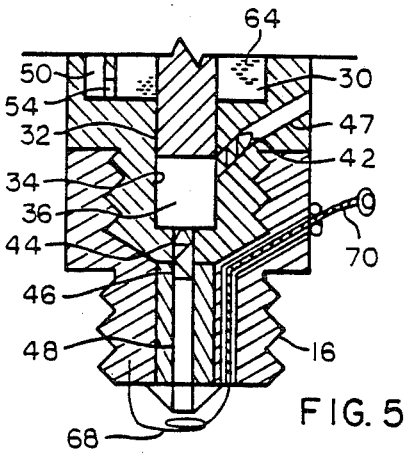
FIG. 5 is a cutaway elevational view of a portion of an injector illustrating an alternative fuel supply system.

Alternatively the fuel may also be fed directly into the fuel supply chamber 36 through a fuel supply passage 47 formed in the lower side portion of injector housing 14 as illustrated in FIG. 5.

Figure 2:
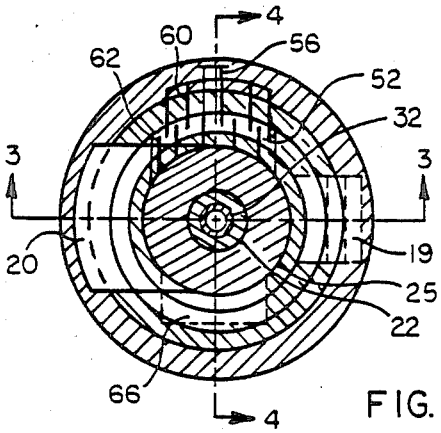
FIG. 2 is a sectional view taken along lines 2—2 of FIG. 1.
Figure 4:
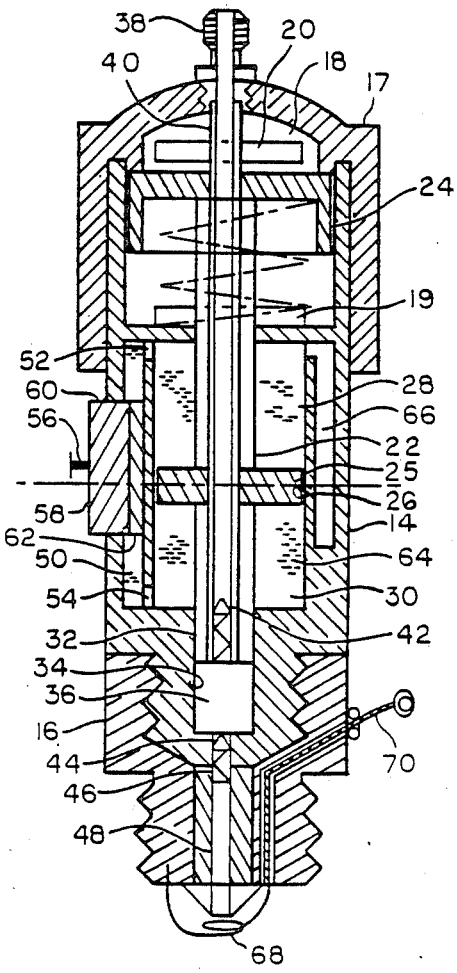
FIG. 4 is a sectional elevational view taken along lines 4—4 of FIG. 2.

Referring now to FIG. 4 it will be noted that a fluid bypass chamber 50 is formed in the side portion of injector housing 14 and provides communication via outlets 52 and 54 between the upper portion 28 and the lower portion 30 of metering chamber 26. An electrical connection 56 is mounted to an insulated housing 58. The connector 56 is conductively connected to a series of electrodes 60 which are best illustrated in FIGS. 1, 2 and 4. As will also be noted in FIGS. 1, 2 and 4 a series of electrodes 62 are conductively mounted to the inner portion of injector housing 14 and are located within the bypass chamber 50. Thus it will be seen that upon application of a voltage to electrical connector 56 an electrical potential will exist between the positive electrodes 60 and the negative electrodes 62, which are grounded through the cylinder head 12 to the electrical system of the vehicle. An electro-rheological fluid 64 completely fills the metering chamber 26 and the bypass chamber 50. An expansion chamber 66 as shown in FIG. 4 is provided in communication with the metering chamber to provide for expansion resulting from a rise in temperature of the fluid. A wire 68 which is heated by an electrical current supplied through an insulated feed line 70 serves to ignite the fuel which is injected into the combustion chamber 11.

OPERATION OF THE DEVICE

In operation of the device, during an engine's compression stroke, the compression from within cylinder head 12 will be transmitted to compression chamber 18 via compression passage 20. Thus the compression pressure will attempt to force the primary piston 24 and the entire ejector rod 22 to a downward position. Unless restrained the secondary piston 32 of injector rod 22 will move into the fuel supply chamber 36 and force the entire fuel supply from supply chamber 36 into the combustion chamber of the cylinder head 12. A timed restraint and release of the injector rod 22 is necessary to permit precisely measured downward movement of the secondary piston 32 into the fuel supply chamber 36 so as to meter the amount of fuel and the timing of its injection into the combustion chamber 11 in accordance with the needs of the engine.

The restraint and release of the injector rod 22 is accomplished by the application and removal of an electrical potential between electrodes 60 and 62. When applied this potential will substantially solidify the electro-rheological fluid 64 between the electrodes 60 and 62. Thus as best seen in FIG. 4 the injector rod 22 can move only when the electro-rheological fluid is in its fluid state which permits flow between chambers 28 and 30 as the metering spool forces the fluid through bypass chamber 50 via the outlets 52 and 54. Substantial solidification of the electro-rheological fluid 64 between the electrodes when the electric potential is applied will instantly block the fluid flow between chambers 28 and 30, thus preventing further movement of the spool 25 and its associated injector rod elements, and thereby limit the amount of fuel forced from fuel supply chamber 36 into combustion chamber 11.

In a partial throttle situation a typical computer controlled system which would be responsive to all criteria necessary for determining fuel flow such as throttle position and timing advance will be connecnted to the electrical connector 56 so as to provide appropriately timed signals thereto.

The air fuel mixture is then ignited by the heated wire 68 or any suitable ignition device.

From the foregoing it will be seen that an improved fuel injector has been devised which may with minimum modification be adapted for use in vehicles originally designed for use with a conventional carburetor fuel system. Thus by use of the improved injector, a typical gasoline engine may utilize a variety of low cost fuels. Furthermore, the improved injector is simple and economical to manufacture in that it utilizes only one moving injector part and may be controlled by electrical pulses supplied by a simple computer in response to the needs of any internal combustion engine.

While the invention has been shown in but one form, it will be obvious to those skilled in the art that it is not so limited but is susceptible to various other changes and modifications without departing from the spirit thereof.

I claim:

1. An injector for delivering fuel into the combustion chamber of an internal combustion engine, said injector comprising:

means for receiving and temporarily retaining fuel;

means responsive to pressure from said combustion chamber for injecting fuel into said combustion chamber; and means comprising an electro-rheological fluid responsive to an electrical potential applied across said fluid for limiting the amount of fuel injected into said combustion chamber by said injection means.

2. An injector assembly for directing fuel into the combustion chamber of an internal combustion engine, said injector assembly comprising:

fuel chamber means for receiving and temporarily retaining fuel;

fuel injection means disposed for displacement for forcing said fuel from said fuel chamber into said combustion chamber;

pressure responsive means for displacement of said fuel injection means responsive to pressure from said combustion chamber;

metering means disposed in said injector assembly, said metering means including a chamber means having a fluid of substantially infinitely variable viscosity therein;

a metering spool carried in said fluid and secured to said fuel injection means for displacement therewith; and, actuation means for energizing said fluid to vary the viscosity thereof and so as to impede or enhance the displacement of said metering spool and said injection means whereby fuel from said fuel chamber means is injected into said combustion chamber in response to pressure from said combustion chamber and whereby the amount of said fuel injected is controlled by said actuation means by selectively increasing or decreasing the viscosity of the fluid within said injector assembly chamber means so as to control the displacement of said metering spool and injection means.

3. An injector assembly as in claim 2 wherein said actuation means is a source of electricity for energizing said fluid so as to vary the viscosity thereof.

4. An injector for delivering fuel into a combustion chamber of an internal combustion engine, said injector including:

an injector housing having a compression passage, a metering chamber, and a fuel supply chamber formed therein;

a nozzle housing attached to one end of said injector housing, said nozzle housing being adapted for communication with said combustion chamber and providing communication between said combustion chamber and said compression passage and between said combustion chamber and said fuel supply chamber in said injector housing;

a compression chamber housing attached to the distal end of said injector housing, said compression chamber housing and said injector housing forming a compression chamber and said compression chamber housing providing communication between said compression chamber and said compression passage to said injector housing;

a hollow injector rod slidably mounted within said injector housing and said compression chamber; said injector rod having a primary piston attached thereto, said primary piston being slidably mounted within said compression chamber, a metering spool attached to said injector rod, said metering spool being slidably mounted within said metering chamber of said injector housing, and a secondary piston attached to said injector rod, said seconday piston being slidably mounted within said fuel supply chamber;

a bypass within said injector housing providing communication between opposite ends of said metering chamber, said bypass having electrical means for selectively providing an electrical potential across said bypass;

an electro-rheological fluid filling said metering chamber and said bypass;

a fuel supply tube attached to said compression chamber housing and passing through the hollow portion of said hollow injector rod and into said fuel supply chamber for supplying fuel through the hollow portion of said injector rod and into said fuel supply chamber;

valve means mounted within said fuel supply tube for preventing reverse flow of said fuel valve means in said nozzle housing for temporary retention of fuel within said fuel supply chamber whereby fuel is expelled in selective amounts from said fuel supply chamber through said nozzle housing by the application of pressure from said combustion chamber through said compression passages and into said compression chamber thereby exerting a driving force upon the primary piston which actuates the metering spool to force flow of the electro-rheological fluid through said bypass in said injector housing, said driving force also actuating said secondary piston which expells fuel from the fuel supply chamber into the combustion chamber, the amount of fuel expelled being controlled by the selective application of an electrical potential across said electrical means of said injector housing bypass which electrical potential substantially solidifies the electro-rheological fluid within the bypass thereby preventing further movement of the metering spool and allowing only a desired displacement of the metering spool and the secondary piston;

and means attached to said nozzle housing for ignition of fuel injected into said combustion chamber.

5. An injector for delivering fuel into the combustion chamber of an internal combustion engine said injector comprising:

a housing assembly;

means for receiving and temporarily retaining fuel, including a fuel supply chamber and a fuel supply passage for delivering fuel to said fuel supply chamber;

means responsive to pressure from said combustion chamber for injecting fuel into said combustion chamber, said fuel injecting means including an injector rod having a primary piston on one end thereof adapted for actuation by pressure from said combustion chamber, and a secondary piston on the other end thereof adapted for explusion of fuel from said fuel supply chamber in response to actuation by said primary piston; and means responsive to an electrical signal for limiting the amount of fuel injected into said combustion chamber by said injection means, said means for limiting the amount of fuel including a metering chamber formed within said housing assembly, a metering spool attached to said injector rod and slidably mounted within said metering chamber and dividing said metering chamber into upper and lower portions, a bypass connecting said upper and lower portions, electrical means for applying an electrical potential across said bypass, an electro-rheological fluid filling said metering chamber and bypass whereby an application of electrical potential across said bypass will substantially solidify fluid therein and limit movement of said metering spool and said injector rod.

6. A fuel injector as set forth in claim 5 wherein said fuel supply passage passes through said injector rod.

7. A fuel injector as set forth in claim 5 wherein said fuel supply passage is formed by said housing assembly.

* * * * *